United States Patent [19]

Wood

[11] 3,999,290

[45] Dec. 28, 1976

[54] SAFETY KNIFE

[76] Inventor: Jess W. Wood, 1410 Randolph, Arlington, Tex. 76010

[22] Filed: Mar. 15, 1976

[21] Appl. No.: 667,168

[52] U.S. Cl. ..... 30/2; 30/162; 83/56

[51] Int. Cl.[2] ..... B67B 7/00; B26D 3/00; B26B 5/00

[58] Field of Search ..... 30/2, 162, 164.9, 280, 30/294, 317; 83/56

[56] References Cited

UNITED STATES PATENTS

| | | | |
|---|---|---|---|
| 2,097,811 | 11/1937 | Foley | 30/280 X |
| 2,376,887 | 5/1945 | Walters | 30/2 X |
| 2,743,523 | 5/1956 | Honey | 30/294 X |
| 2,874,462 | 2/1959 | Benedict | 30/162 |

*Primary Examiner*—Gary L. Smith
*Attorney, Agent, or Firm*—Charles W. McHugh

[57] ABSTRACT

A safety knife adapted for cutting corrugated cardboard boxes and the like which is characterized by having a cutting blade which is continuously biased toward a retracted position within the knife's handle. The blade is held within a carriage that is slidable along a groove within the handle. A tension spring attached to the carriage urges the carriage toward its retracted position at all times. A dragging means is provided for pulling the carriage out of the handle and bringing the blade into contact with a structure to be cut. In one embodiment, this dragging means includes a cantilevered wire firmly attached to the slidable carriage, with the distal end of said wire having a hook which is adapted to drag along the structure to be cut. When the blade is cutting, the wire flexes backward into a position alongside the blade where it does not interfere with the cutting action. If the blade is ever withdrawn from the cardboard being cut, the tension spring immediately pulls the blade safely back into the handle. Depending upon whether the hook normally rests in a protruding position, or whether it normally rests in a sheltered position where it is at least partially shielded by the handle, the knife can be designed to begin cutting anywhere along a planar surface or a cut may be initiated only at the edge of a surface. In another embodiment, the dragging means includes a cantilevered arm made of a material like nylon or acetal resin; a serrated tip is typically provided at the end of such an arm so that the tip may be engaged with the structure to be cut. After engaging the tip, pulling the handle along the surface to be cut automatically pulls the carriage out of the handle and brings the blade into a cutting position. The handle is designed to be firmly gripped in a convenient manner, with all fingers being held in a natural position. No special "finger control" is necessary to keep the blade extended, and the knife may even be easily used by a person wearing bulky gloves.

14 Claims, 11 Drawing Figures

FIG. 7
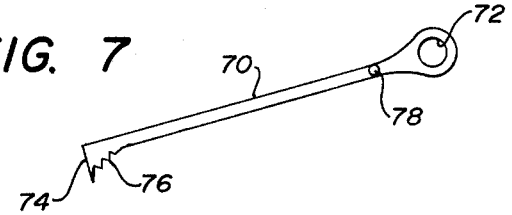
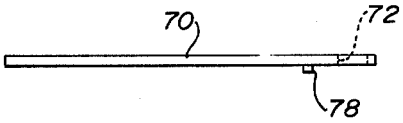
FIG. 6
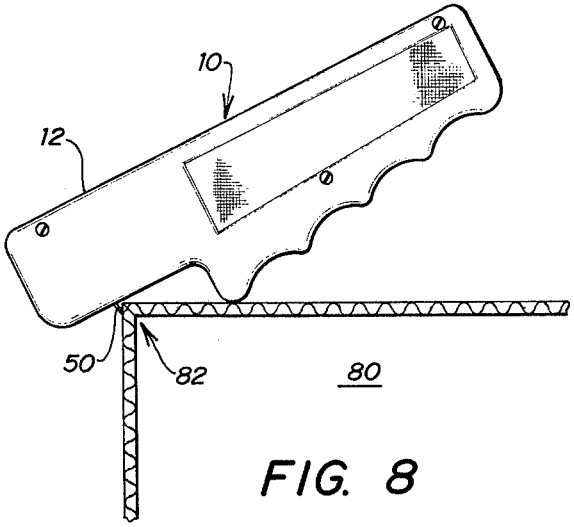
FIG. 8
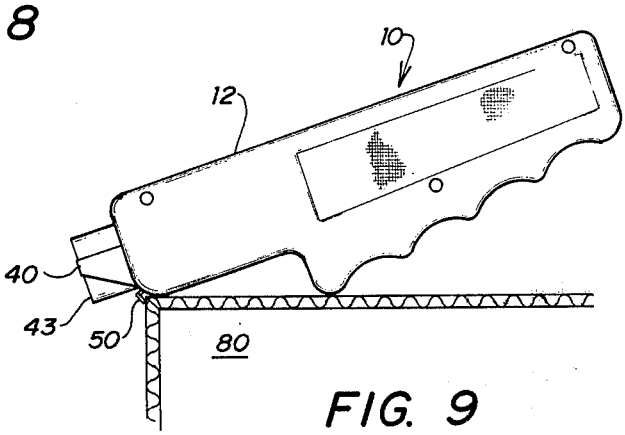
FIG. 9
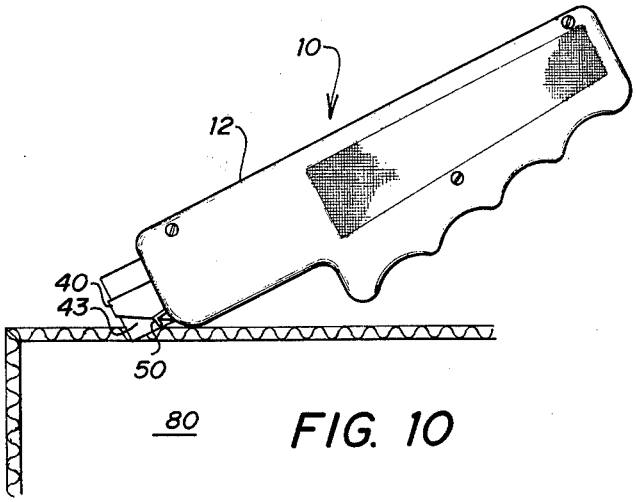
FIG. 10
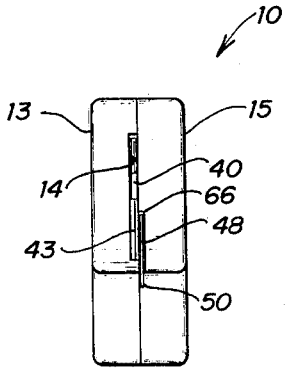
FIG. 11

SAFETY KNIFE

This invention relates generally to safety knives for cutting corrugated cardboard boxes and the like, and it particularly relates to a knife in which a cutting blade is continuously biased toward a retracted position within the knife's handle.

Modern techniques for distributing dry goods in many countries frequently involve the packaging of such goods in so-called cardboard shipping containers and/or boxes. Such containers are also referred to as corrugated boxes, because they are made from double-wall or triple-wall corrugated fibreboard or cardboard. After such shipping containers are filled, they are typically sealed in order to prevent the entrance of dirt and the like, as well as to guard against accidental loss of the contents. When the boxes have arrived at their destination, it is essential that they be opened—preferably with a minimum amount of consumed time, commensurate with the risk to the contents and the person who is opening the cartons. This is routinely accomplished by cutting the boxes with a hand-held knife, either along three contiguous edges (so that a lid is formed that may be rotated upward and away from the box), or along four edges so that a complete side can be removed from the box. In order to minimize the chance of damage to the contents of a box which is being cut, it has been common to employ so-called safety knives. Such knives frequently have a mechanical apparatus for preventing a knife blade from extending so far beyond a handle that the blade might cut too deeply through a cardboard wall as the knife handle is pulled therealong. Exemplary of such knives that are primarily concerned with protecting the contents of boxes are those knives shown in U.S. Pat. Nos. 3,178,812 and 3,184,843 to Lurie.

Other knives have been built which were primarily directed to the problem of safety for the user. For example, U.S. Pat. No. 2,474,609 to Wolf discloses a safety knife in which a push-button is rigidly attached to a blade, and the blade must be held in a forward position against the tension in a spring in order to keep the blade extended to a cutting position. If the push button is released, the spring immediately retracts the blade into a safe position in the handle. Still another cutting tool of the same general type is shown in U.S. Pat. No. 2,550,346 to Gregg. In the Gregg device, a leaf spring normally biases the blade to a retracted position within a handle, and when cutting is desired a finger-piece is pressed so as to overcome the biasing spring.

While all of these devices of the prior art no doubt have had some advantages, they are still lacking in some characteristics that are desirable in safety knives. Hence, there has still been a demand for a knife that will find favor with both employers and employees (who presumably will be the knife users). The concept of identifying employees and employers as perhaps having different interests when it comes to safety knives is based upon the recognition that employees usually tend to favor a knife that is easy to handle, sharp, and enables them to accomplish their assigned task without difficulty. On the other hand, employers (and safety personnel) usually favor a knife that tends to minimize accidents to employees and damage to the packaged goods. Accordingly, it is an object of this invention to provide a safety knife which strikes a good compromise between safety for both goods and the user, and which is not awkward to use.

Another object is to provide a knife which requires relatively little personal attention by the user, so tht he may concentrate his attention on other matters.

A further object is to provide a safety knife which does not require continued pressure by a finger against a biasing spring, such that a user may wear heavy gloves and find the knife just as convenient when he holds it with a gloved hand as it is when held with a bare hand.

A still further object is to provide a safety knife which can utilize replaceable razor blades and the like. These and other objects will be apparent from a reading of the specification and claims appended thereto, and the attached drawing in which:

FIGS. 6 and 7 are top and side views, respectively, of an alternate means for pulling a cutting blade out of a handle and into contact with a structure to be cut. Such a structure would typically be molded of a plastic material having appropriate structural characteristics, and which would typically replace a metal wire as shown in FIG. 3.

FIG. 8 is a side elevational view of the safety knife as it would typically be positioned in order to initiate a cut through the upper wall (top) of a cardboard container.

FIG. 9 is a side elevational view of the safety knife, wherein the handle has been pulled slightly to the right while the hook and the attached blade have remained where they are gently held by the corner of the cardboard container.

FIG. 10 is a side elevational view of the safety knife wherein the various parts of the knife are shown in their working positions after the blade has cut along the upper wall of the container for a short distance.

FIG. 11 is a front view of the safety knife showing the position of the carriage in the open groove in the handle front.

In brief, the invention includes a handle and a blade-holding carriage which is slidably received in the handle. A tension spring is attached to the handle for retaining the carriage in a retracted position where the blade does not protrude outside of the handle's envelope. A small hook mounted in a cantilevered fashion is firmly secured to the carriage so that it moves with the carriage. The small hook is positioned so that it protrudes by a relatively short distance beyond the handle's envelope when the carriage is fully retracted into the handle; and, the hook is oriented such that it can be placed against a cardboard carton or the like to firmly engage the carton. Once the hook has become so engaged with the carton, it will offer resistance against a backward pull on the handle—such that the carriage (and the blade held therein) is automatically pulled out of the handle into a cutting position. The cantilever-mounted hook then flexes upwardly into the handle sufficiently to permit the blade to accomplish its function in cutting the box as the handle is drawn along same. If the handle is ever pulled transversely away from the box, there is nothing to hold the carriage against the tension spring and the carriage is immediately drawn safely backward into the handle.

Figure 1:
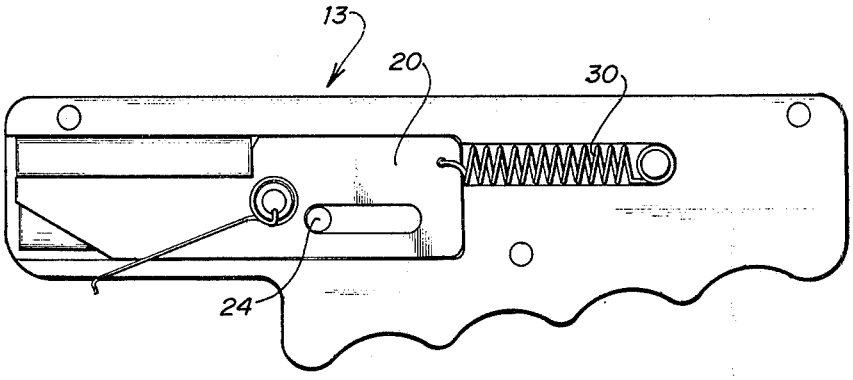
FIG. 1 is a front (interior) elevational view of one-half of a knife made in accordance with the invention, wherein the handle of the knife is made of a molded material. In this view, a carriage which holds a conventional single-edge razor blade is shown in its fully retracted position with respect to the right half of the handle.
Figure 2:
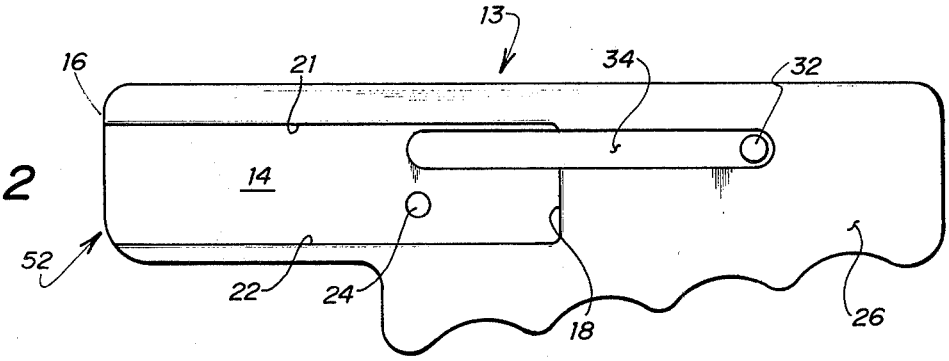
FIG. 2 is a front elevational view of the same half of the handle as shown in FIG. 1, with the blade carriage being omitted in this view.

Referring initially to the embodiment shown in FIGS. 1 and 2, the safety knife 10 includes a handle 12 having a cavity therein, with a portion of the cavity being elongated to define a groove 14. The groove, which can best be seen in FIG. 2, extends from the front of the handle 16 to a position near the midpoint of the handle. The interior end 18 of the groove 14 is preferably finished in such a way that if forms a mechanical stop for the carriage 20. In this way one half of the handle itself may be molded or otherwise shaped so as to provide one of the mechanical restraints on movement of a free-floating carriage 20. Another restraint on the carriage 20 is provided by upper wall 21 which extends for the length of the groove 14; bottom wall 22 similarly serves a restraining function for the sliding carriage 20. Since the groove 14 is open at the handle front 16, it is preferred that there be a mechanical means for preventing the carriage 20 from being pulled out of the handle too far—such that the restraining spring 30 might be stretched beyond its yield point. Accordingly, a stud or protuberance 24 is advantageously formed integrally with the handle 12, so that it extends up through the groove 14 —and typically as high as the inside plane 26 of the right half of the handle shown in FIG. 2.

Figure 3:
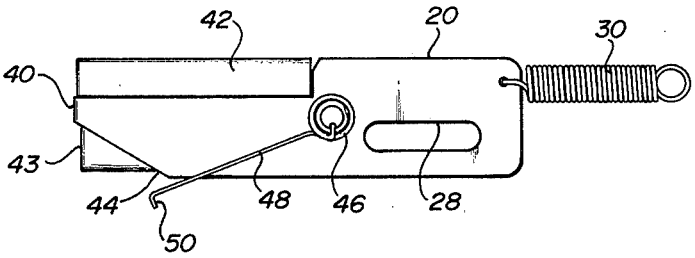
FIG. 3 is an elevational view of the carriage and a razor blade mounted therein, with the carriage having the same orientation as it has in FIG. 1. Thus, FIG. 3 could be superimposed over FIG. 2 in order to arrive at a view equivalent to FIG. 1.

With additional reference to FIG. 3, an elongated aperture 28 is provided in the carriage 20 at a location where it fits over protuberance 24. The permitted length of travel of the carriage 20 is therefore a function of the longitudinal clearance between aperture 28 and protuberance 24. In order to bias the carriage 20 toward its retracted position within the handle at all times, a tension spring 30 is affixed at one of its ends to the carriage and at its opposite end to the handle. In the embodiment of FIGS. 1 and 2, a pin 32 extends transversely to a groove 34 which is sized so as to freely accommodate the tension spring 30.

Figure 4:
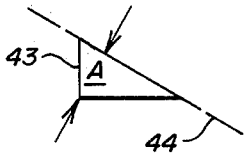
FIG. 4 is a fragmentary view of the exposed portion of a conventional single-edge razor blade, which portion is in a cutting position as soon as the carriage is pulled out of the handle.

With particular attention to FIG. 3, the carriage 20 has a frontal portion which is reduced in height compared to its rearward portion. And, the carriage consists of one thin metal side connected to another thin rigid side by a narrow web 40, so that the two adjacent sides define a thin cavity therebetween for receiving a cutting blade. In the embodiment shown in FIG. 3, said cutting blade is a common single-edge razor blade 42 of the type shown in U.S. Pat. No. 2,730,800 to Bailey. Such old-fashioned razor blades are widely available, they are relatively cheap, and they usually provide an effective cutting edge for an adequate period of time. However, the concept disclosed herein should not be interpreted as being restricted to use of conventional blades; if desired, a manufacturer could certainly design a special configuration for the carriage so that it would only accept special blades, such as those shown in U.S. Pat. No. 2,474,609 to Wolf. A lower front corner of the carriage 20 is cut away to define inclined edge 44, such that a portion of the razor blade 42 extends downwardly where it is exposed below edge 44. As indicated in FIG. 4, the extent to which frontal edge 44 is cut back will inherently define the cutting depth of the exposed blade 42. Hence, once a decision is made by a manufacturer as to the depth of cut that will be possible with the knife 10, that maximum depth will be built into the knife and the user will not be able to cut any deeper. In this way, then, a manufacturer can guarantee to a purchaser that use of the safety knife will limit cutting action to a depth of, say, ¼ inch, etc. This distance is represented by the dimension A in FIG. 4.

Also shown in FIG. 3 is an anchor 46 rigidly secured to the side of carriage 20. Attached to this anchor 46 is a spring steel wire 48 which extends in a cantilevered fashion toward the front of the carriage 20. The wire 48 is preferably high tensile strength, spring steel wire, sometimes referred to as "music" wire. The wire preferably is about 20 gauge (i.e., about 0.036 inch), and it is relatively stiff so that it will tend to hold a position into which it is set. Because of its inherent resiliency, however, it will flex with respect to anchor 46 so that its distal end can be rotated about anchor 46 with a somewhat modest force. Integral with the distal end of wire 48 is a small hook 50 which is inclined with respect to the linear part of wire 48 so as to form an angle with the wire of about 90°. The linear part of the wire 48 will normally be about 1½ or so inches long, and the hook portion will normally be about ⅛ inch long. Having now identified the wire 48, it will be meaningful to refer back to FIG. 2 in which a small portion of the lower front edge of groove 14 is relieved so as to form a mouth 52 through which the distal end of wire 48 (and hook 50) extend. The extent to which the groove 14 is relieved longitudinally in order to establish mouth 52 will be a function of the length of wire 48; the mouth will typically be about ⅜ inch long, as measured from the handle's front end 16.

In deciding exactly what force should be required in order to cause the wire 48 to flex, a decision must first be reached concerning the preferred mode of operation of the knife. Thus, the safety knife 10 can be made so that it will begin a cut only at an edge or a corner of a box; or a cut can be initiated at any place along a flat piece of cardboard—if that should be desirable. In the first "edge-only" case, the wire 48 will normally be much more yielding than the second, "cut-anywhere" embodiment. Hence, if the handle of an edge-only knife is simply pressed against a flat, smooth piece of cardboard, the wire 48 will merely yield and the hook 50 will be pushed upward into the mouth 52. That is, a "soft" wire 48 will not be expected to exert sufficient resisting forces in a direction generally perpendicular to the major length of the wire so as to cause hook 50 to puncture the outer skin of the cardboard against which it is being pressed. On the other hand, if it is desired that a user be able to initiate cutting action anywhere on a flat surface, all that is required is that the wire 48 be made stiff enough or be mounted in such a way that it does not readily yield to a force applied in a direction generally co-axially with the hook. With a wire 48 which is relatively stiff, the hook 50 may be caused to pierce most any external surface on an article which is to be cut. And, as will be explained in more detail hereinafter, such a "piercing" action is usually all that is needed in order to render the knife operational. To the extent that a "firm" wire 48 might cause a hook to successfully pierce cardboard, however, it is true that the same hook might well pierce a person's skin if it forcefully came in contact with a finger or hand. Therefore, in order to give maximum emphasis to safety for the user, the preferred embodiment of the invention includes a wire 48 whose distal hook 50 is easily pushed backward into the housing with a relatively small force, i.e., a force of only about 5 ounces. With such an embodiment, dropping the knife 10 on a person's foot or hand with an orientation such that the hook 50 bears axially against that person's flesh will normally cause no damage, because the wire 48 will yield so readily to forces applied perpendicularly to the main body of said wire.

Having described one-half of the handle and the carriage that slides along a groove therein, the matching half 15 of a molded handle will now be described, and attention is now directed to FIG. 5. Assuming that the right half 13 of handle 12 has a groove 14 which is deep enough to fully accept carriage 20, the matching side of piece 15 could be relatively flat. However, it normally will be desirable that tension spring 30 be centered in the handle 12, so a groove 35 having a semi-circular cross-section will be typically provided in piece 15 where it exactly matches groove 34. Taken together, the two grooves 34, 35 define a cylindrical cavity just slightly larger than the diameter of coil spring 30, so that the two grooves foster uninterrupted flexure in the tension spring 30. Also, if the anchor pin 46 which is attached to the carriage 20 extends upwardly for a significant distance—which it will usually do in order to provide a sufficient base upon which wire 48 is wrapped, then a corresponding recess 56 will be provided in the half-handle 15 so as to provide clearance for anchor 46 as the carriage translates to and from its extreme positions.

Figure 5:
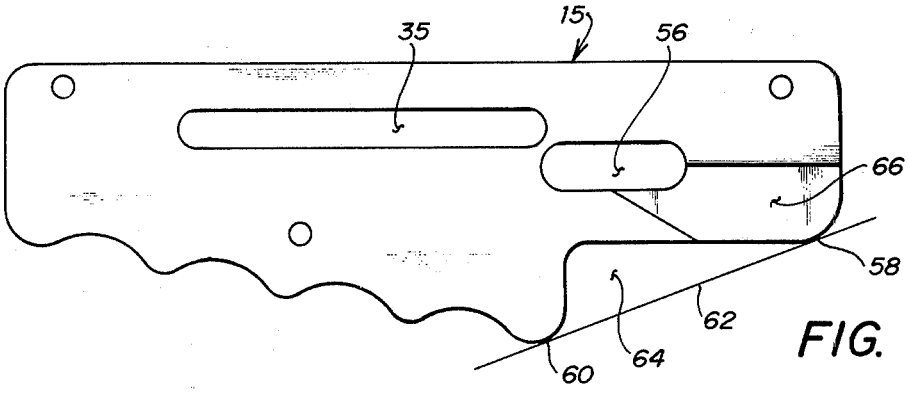
FIG. 5 is an interior elevational view of the left half of a molded handle for the knife. In order to assemble a complete handle, a right-half as shown in FIG. 2 would be juxtaposed with a left-half as shown in FIG. 5, with the two halves being held together with bolts or other fasteners.

Another characteristic of the preferred embodiment of the invention will be apparent in FIG. 5, namely, that there are two protruding portions 58, 60 on the handle 12. By extending a plane represented by line 62 through the two extreme points of said protruding portions 58, 60, it will be seen that there is a concave region 64 in the handle 12 between the two extreme points. If the wire 48 is sized so that the complete hook 50 lies interiorly of the plane 62 (i.e., between the plane 62 and the handle), then there would be no way that the user could approach a flat surface and begin a cut on that surface. Of course, a user could still initiate a cut at the edge of a box, by placing the knife next to a corner in such a way that the hook could bear against the edge of a planar surface. An exemplary position for starting a cut with a "protected" hook 50 is shown in FIG. 8. Having once engaged the edge of a planar surface, all that remains is for the user to pull the handle 12 along said surface. The resisting force imposed upon the hook 50 by the cardboard being cut will pull the carriage out and drive the blade 43 into the cardboard. Once the blade has been pulled out of the handle and is cutting, it will remain out by virtue of the gripping action of the edges of the just-completed cut against the sides of the blade 43. Also, friction between the top edge 21 of groove 14 against the top of blade 43 and/or carriage 20 may also contribute to some extent in holding the carriage 20 in an extended position. In general, the tension spring 30 will usually be designed so that a force of about 10 ounces will be required to fully extend the carriage 20; and the gripping force which is realized from a fresh cut in double-face cardboard will normally be more than adequate to keep the carriage extended. Indeed, if the cut is being made across the pleats rather than parallel to the same, the gripping force manifested by the cut cardboard on said blade 43 will be found to be substantial.

In view of the fact that the structure being cut (e.g., corrugated fibreboard) will usually hold a razor blade in a position to continue cutting, the hook 50 really has no substantial purpose at this time. It is appropriate, therefore, that the wire 48 flex backward within a relieved space alongside the front of carriage 20, so that the hook 50 will move slightly backward. This narrow space is indicated by the region 66 in the molded handle piece 15 shown in FIG. 5. Because the wire 48 continuously biases the hook 50 downward, however, said hook will be continuously dragging along the surface of the structure being cut. Therefore, there will typically be three things tending to hold the carriage in an extended position during cutting: 1) pressure exerted by the cut cardboard against the sides of the cutting blade; 2) friction between the top edge 21 and the top of the blade and/or carriage; and 3) the continued action of the hook 50 dragging along the surface of the material being cut. Of course, the degree of this continued dragging action by the hook 50 will be a function of the surface at the very end of said hook. That is, if the end of the wire 48 (which defines the hook 50) is de-burred and smooth, it will tend to slide more easily over the surface being cut—thereby reducing any dragging function along a planar surface. On the other hand, if the burr which is commonly formed during many cut-off operations on the wire 48 is left intact, then the continued dragging action of hook 50 along a planar surface will be present. In the preferred embodiment of the invention, such a burr is always present, either as the inherent result of a cut-off operation or as the result of deliberately forming an equivalent configuration at the end of wire 48.

Referring next to FIG. 7, an alternate means for pulling the cutting blade into contact with a structure to be cut includes an arm 70 having a journal 72 at one end for mounting said arm on a carriage 20. A suitable material for the arm 70 is nylon or an acetal resin such as DuPont's Delrin polymarized resin, both of which have good resistance to fatique. At the distal end of arm 70 is an enlarged tip 74 having a serrated surface 76 oriented downwardly where it may readily bear against the corner of a box, etc. Since the arm 70 would freely rotate about anchor 46 if the arm was not restrained in some way, it is essential that the arm be fixed against rotation at its proximate end—so that its distal end may be flexed in the same manner as the aforementioned wire 48. An appropriate manner of restraining the arm 70 is to provide some form of a protuberance which will mate with a corresponding recess on the carriage 20 in order to preclude unrestrained rotation of the arm. The protuberance may extend within the journal 72 in the manner of a key, or it may be affixed to the side of arm 70, as indicated by the numeral 78 in FIG. 7.

FIGS. 8, 9 and 10, show the use of an embodiment of the safety knife in which the means for pulling the blade out of the handle constitutes a wire 48 with a hook 50 at the end thereof. Initially, the handle 12 will be manually positioned as shown in FIG. 8 so that the hook 50 bears against a corner 82 of the box 80. When the handle 12 is pulled a short distance to the right, as illustrated in FIG. 9, the hook 50 will be held fast by the corner 82 so that it does not move with the handle. Of course, the carriage 20 is firmly secured to the proximate end of the wire 48, and so the carriage 20 remains with the static hook 50 while the handle 12 is pulled to the right. The effect of this is to pull the carriage 20 and the blade 43 out of the handle's cavity, such that a corner of the blade is now in an exposed, cutting position. By continuing to pull the handle 12 to the right, the blade 43 will begin to cut through the cardboard immediately below the handle in the manner of a conventional safety knife. That is, once the blade has been pulled from its position of safety within the handle, the knife 10 operates like a conventional knife—and no special training or aptitude is requred in order to make full and efficient use of the knife. Too, the user is not required to maintain any unique alignment between the knife 10 and a container to be cut; and the user is not required to constantly keep one of his fingers on a trigger or the like in order to insure that the blade remains in an extended, cutting position. This is particularly advantageous when a container being opened is relatively long or tall, such as a cardboard container in which a refrigerator has been shipped. With this safety knife, then, a user may reach high above his head to begin a cut and continue that cut vertically to a region near his feet without ever making a substantial change in the grip which he has on the handle 12.

A further advantage of the disclosed construction which "automatically" brings the blade 43 out into cutting position when it is needed is that the handle 12 may be held in a manner which is very natural with regard to gripping an object with a hand. That is, the handle 12 may be gripped in such a way that the user's four fingers are wrapped around the handle and point back toward the user's wrist, while the user's thumb points away from the wrist. By making this natural gripping action possible—with either a right or a left hand, the user is less likely to lose control over the knife such that he might drop it. If he did drop it, however, the blade would not damage his feet or any other thing—because the blade is immediately drawn safely back into the handle 12 by spring 30 just as soon as contact between the knife and the carton is interrupted.

Still another advantage of the safety knife disclosed herein is that there is no need to press on a small button or the like in order to keep the cutting blade extended. Once cutting has been initiated by pulling on the handle 12 in a direction away from an engaged hook 50, there are three friction forces that tend to keep the blade extended—any one of which could be enough to keep the blade in an exposed and cutting position. Hence, a person should be able to cut with the safety knife 10 just as well when he is wearing bulky gloves as when his hands are bare. That is, the hook 50 does not rely upon any finely tuned finger-operated control, and it is insensitive to how the handle is being gripped. Indeed, it is presumed that the safety knife of this invention could even be readily handled by a person with a prosthetic hand.

While only the preferred embodiments of the invention have been disclosed herein in great detail, it will be apparent to those skilled in the art that modification thereof can be made without departing from the spirit of the invention. Thus, the specific structures shown herein are intended to be exemplary and are not meant to be limiting, except as described in the claims appended hereto.

What is claimed is:

1. A safety knife, comprising:

a. a handle having a cavity therein, with a portion of the cavity being elongated to define a groove;

b. a carriage slidable along the groove in the handle, and said carriage being adapted to hold a blade, with said carriage having a retracted position within the handle at which the blade does not protrude outside of the handle, and said carriage also having an extended position at which the blade partially lies beyond the boundary of the handle such that a portion of the blade is exposed for cutting;

c. spring means for biasing said carriage toward its retracted position at all times; and d. means for pulling the blade into contact with a structure to be cut, with said means including an element for dragging along said structure and for pulling the carriage in opposition to the spring means from its retracted position toward its extended position as the handle is moved across the surface of the structure to be cut.

2. The safety knife as claimed in claim 1 wherein said means for pulling the blade into contact with the structure to be cut includes a hook which protrudes from the handle in an exposed position during those times when the carriage has been returned to its fully retracted position.

3. The safety knife as claimed in claim 1 wherein said means for pulling the blade into contact with the structure to be cut includes a wire which is attached at its proximate end to the carriage, and which has a distal end that extends alongside the blade when the carriage is in its extended position.

4. The safety knife as claimed in claim 3 wherein said wire has the physical properties of spring steel "music" wire, and it has a diameter of about 0.036 inch, and the wire has a length in excess of one inch from its proximate end to its distal end, such that said wire can be readily flexed to a position that does not interfere with normal cutting operations of the knife.

5. The safety knife as claimed in claim 1 wherein said element for dragging along the structure to be cut constitutes a cantilevered wire whose distal end has a configuration for interfering with the smooth passage of the knife over the structure to be cut when the handle is held against same.

6. The safety knife as claimed in claim 5 wherein the force which is effective to flex the cantilevered wire in a direction generally perpendicular to the wire's major length is about 5 ounces.

7. The safety knife as claimed in claim 1 wherein said element for dragging along the structure to be cut constitutes an arm made from material having the structural characteristics of an acetal resin, and said arm having a serrated surface at its distal ends.

8. The safety knife as claimed in claim 1 wherein the handle has two protruding portions with a concave section therebetween, and wherein the element for dragging along the structure to be cut lies interiorly of a plane that extends between the extreme points of said two protruding portions, whereby the dragging element is protected against unwanted engagement with a planar surface.

9. The safety knife as claimed in claim 1 wherein the carriage constitutes a relatively thin U-shaped structure, with there being a recess in said U-shaped carriage for receiving a conventional single-edge razor blade.

10. The method of automatically providing a blade in cutting position outside the handle of a safety knife, with there being a non-elastic but resilient member mounted in a cantilevered manner with respect to the cutting blade, with said resilient member having a distal end which lies exteriorly of the handle of said safety knife, comprising the steps of:

moving the handle adjacent the structure to be cut in such a way as to drag the distal end of said resilient member against the surface of the structure to be cut, with said dragging being in a direction toward the handle such that the resisting force exerted by the structure against such dragging is in a direction away from the handle, so that the cutting blade is pulled out of the handle by the force which resists such dragging.

11. The method as claimed in claim 10 wherein a biasing spring is provided within the handle to continuously bias the cutting blade to a retracted position within the handle, and the resisting force which opposes dragging the distal end over the structure is in a direction opposite to the force exerted by said biasing spring, so that moving the handle adjacent the structure to be cut causes the blade to be pulled out of the handle in opposition to said biasing spring.

12. A safety knife, comprising:

a. a handle having an exterior configuration adapted to be easily grasped by a person's hand, and the handle having a thin and elongated cavity therein, with a portion of the cavity defining a groove which extends in a direction generally parallel to the longitudinal axis of the handle;

b. an U-shaped carriage slidable along the groove in said handle, and said carriage being adapted to hold a cutting blade, with said carriage having a first position wherein it is fully retracted within the handle and the cutting blade is similarly retracted completely within the handle, and said carriage having a second position in which it is partially extended out of the front of said handle, with the cutting blade having a cutting edge exposed outside of the handle when the carriage is in its second position;

c. mechanical stops for limiting travel of the carriage so that it is restricted to excursions between the first and second carriage positions;

d. a tension spring for biasing the carriage toward its first, retracted position at all times;

e. a cantilevered wire attached at its proximate end to the side of the carriage, and said wire being extended in a forwardly direction such that it lies alongside the carriage and protrudes for a short distance outside of the handle at all times; and f. a hook provided at the distal end of said wire, with the hook having an inclination which is generally perpendicular to the longitudinal axis of the handle, whereby said hook may be engaged with a structure to be cut so that it will resist movement of the carriage in a direction generally parallel to the longitudinal axis of the handle as the handle is pulled backward.

13. The safety knife as claimed in claim 12 wherein the hook extends outwardly from the handle for a distance of about ⅛ inch when the carriage is fully retracted to its first position.

14. The safety knife as claimed in claim 12 wherein the hook protrudes outwardly from the handle within a generally concave portion of said handle, whereby engagement of the hook with some structure will typically require an overt action on the part of the user to effect such an engagement, and accidental engagement of the hook with some structure is normally avoided.

* * * * *